United States Patent [19]

Smith, Jr.

[11] Patent Number: 4,479,691

[45] Date of Patent: Oct. 30, 1984

[54] CONNECTOR ASSEMBLY

[75] Inventor: Frank L. Smith, Jr., Naperville, Ill.

[73] Assignee: Molex Incorporated, Lisle, Ill.

[21] Appl. No.: 493,854

[22] Filed: May 12, 1983

[51] Int. Cl.[3] ..... H01R 11/01

[52] U.S. Cl. ..... 339/59 M; 339/94 M; 339/186 M

[58] Field of Search ..... 339/59 R, 59 M, 184 R, 339/184 M, 186 R, 186 M, 94 M

[56] References Cited

U.S. PATENT DOCUMENTS

| | | | |
|---|---|---|---|
| 3,286,222 | 11/1966 | Marley et al. | 339/184 M |
| 3,351,892 | 11/1967 | Feeser | 339/184 R |
| 3,745,512 | 7/1973 | Johnson et al. | 339/59 M |
| 3,808,578 | 4/1974 | Hansen | 339/59 M |
| 3,982,805 | 9/1976 | Irie | 339/59 R |
| 4,127,314 | 11/1978 | Hasimoto | 339/59 M |
| 4,238,140 | 12/1980 | Cairns et al. | 339/186 M |
| 4,258,972 | 3/1981 | Strate | 339/59 R |
| 4,343,523 | 8/1982 | Cairns et al. | 339/59 M |
| 4,386,816 | 6/1983 | Frear et al. | 339/59 R |

*Primary Examiner*—John McQuade
*Assistant Examiner*—Thomas M. Kline
*Attorney, Agent, or Firm*—Louis A. Hecht

[57] ABSTRACT

A connector assembly which includes a pair of mateable connector halves having terminals mounted in housings. The connector assembly includes means for preventing the mating of the connector halves if any one terminals is not fully inserted into a corresponding cavity in a housing. A plurality of relatively rigid polarizing projections are provided on each housing which are received within corresponding recesses formed adjacent each terminal receiving cavity in the opposite housing. A flexible wall is disposed between each recess and the adjacent terminal receiving cavity. The flexible wall is movable towards the interior of the recess when the terminal in the adjacent cavity is not fully inserted therein in order to prevent the receipt of the corresponding projection in the recess.

7 Claims, 8 Drawing Figures

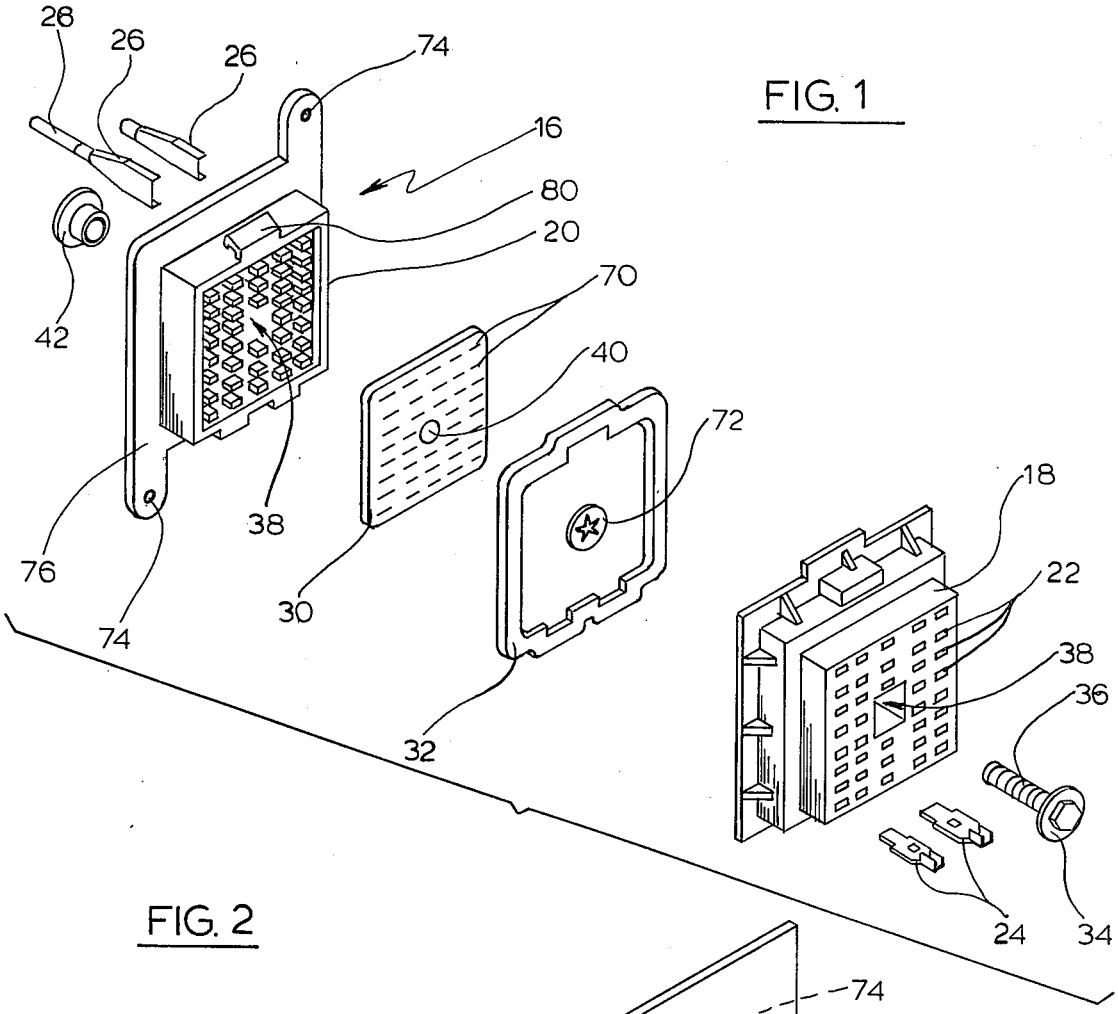
FIG. 1
FIG. 2
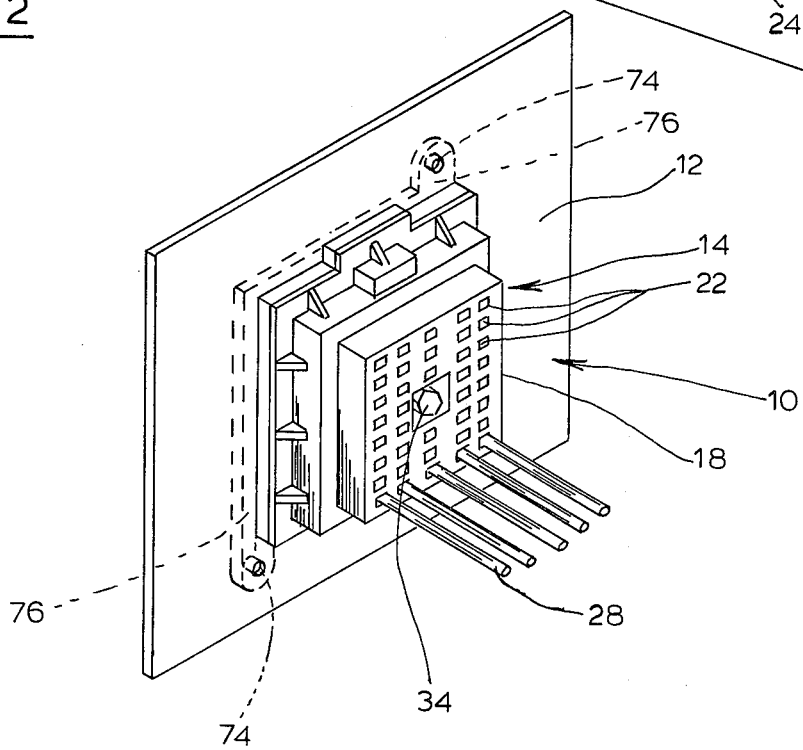

CONNECTOR ASSEMBLY

BACKGROUND OF THE INVENTION

1. Field of the Invention

The present invention relates to a connector assembly comprising a pair of mateable connector halves, each connector half including a housing with terminals mounted therein. More particularly, the present invention relates to a connector assembly of the type described including means to ensure that each terminal is positively locked in its respective housing.

2. Description of the Prior Art

Electrical connector assemblies which comprise a pair of matable connector halves, each half including a plurality of wire connected terminals mounted within a connector housing, are widely used in appliances such as vehicles, electronic computers, automatic vending machines, etc. When the two connector halves are mated, mutual connection of the respective terminals is effected. In such connectors, it is required that the terminal be retained securely in a given position of the housing. Otherwise, the connector may not function properly because the connectors may not be mated with each other causing an incomplete connection. Likewise, the connector assembly must not allow the terminals to be disengaged after being mounted therein for the same reasons.

Each of the connector halves which comprise the assembly has a housing with a plurality of terminal receiving cavities formed therein facing opposing cavities formed in the housing of the other connector half. Each cavity is provided with a wall. A group of terminals are mounted in the cavities along side of the wall. The terminals mounted in the opposing cavities are in alignment with one another so as to define mateable terminal pairs. Terminal locking means are provided which cooperate between each terminal and the wall of its respective cavity in order to lock the terminal therein. The locking means has means interengaging between the cavity wall and the terminal only when the terminal is fully inserted within its cavity. By this design, the terminal pairs are interconnected and mated when the connector halves are moved together.

Though the above general structure provides suitable means for positively locking the respective terminals within its terminal receiving cavities, it is still possible to mate the housings of each connector half to one another even though all of the terminals have not been fully inserted therein.

SUMMARY OF THE INVENTION

It is, therefore, the principal object of the present invention to provide a connector assembly of the type described above which includes means for preventing the mating of the connector halves if any one terminal is not fully inserted into its corresponding terminal receiving cavity.

This and other objects of the present invention are accomplished by providing mating prevention means comprising:

a plurality of relatively rigid polarizing projections integrally formed with and extending from at least one housing between at least some of said cavities, said projections are adapted to be received within corresponding recesses formed adjacent each terminal receiving cavity in the opposite housing when said connector halves are fully mated, each recess having a flexible wall that is common with the adjacent cavity, said flexible wall being moveable toward the interior of the recess when the terminal in the adjacent cavity is not fully inserted therein preventing the receipt of the corresponding projection in said recess, whereby the connector halves cannot be mated if any one projection cannot be received in its corresponding recess.

BRIEF DESCRIPTION OF THE DRAWINGS

FIG. 1 is an exploded perspective view of the connector assembly of the present invention;

FIG. 2 is a perspective view of a fully assembled connector assembly of the present invention mounted on a panel;

DESCRIPTION OF THE PREFERRED EMBODIMENT

Figure 3:
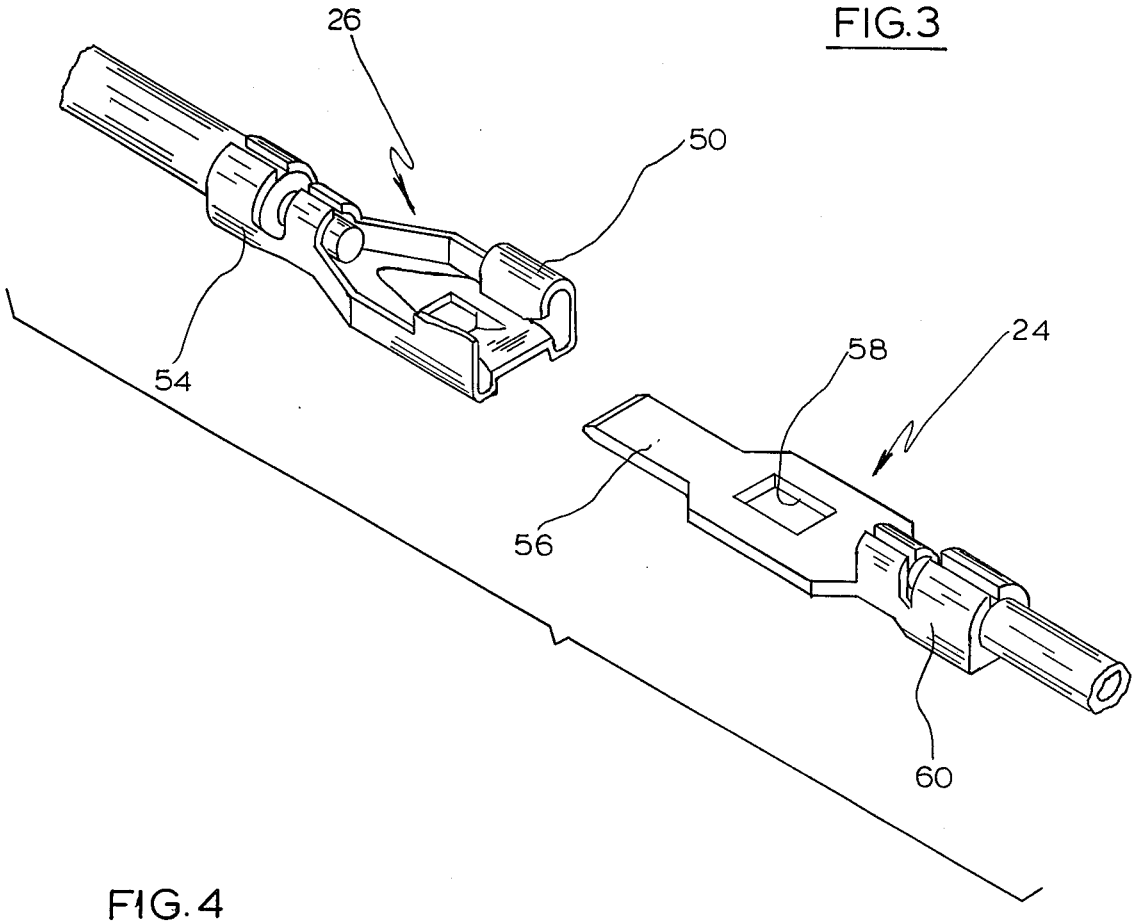
FIG. 3 is an enlarged perspective view of a mating terminal pair which is housed within the connector assembly of the present invention.

Turning now to FIG. 2, the connector assembly of the present invention, generally designated 10, is seen fully assembled and mounted on a panel 12. The connector assembly 10 is seen to generally include two connector halves, generally designated 14 and 16, each connector half including two housings 18 and 20, respectively, which are molded from insulating material. Each housing 18 and 20 has a plurality of terminal receiving cavities 22 formed therein. The cavities 22 of housing 18 are adapted to receive male terminals 24 therein whereas the cavities 22 of housing 20 are adapted to receive female terminals 26 therein. The terminals 24 and 26 are crimped to insulated wires 28 in a fashion that is well known in the art.

The terminal receiving cavities 22 of each connector half 14 and 16 are opposed to and aligned with one another. The terminals 24 and 26 when mounted in the cavities 22 are in alignment with one another and are designed to electrically contact one another when the connector halves 14 and 16 are mated.

The connector assembly 10 is provided with an interior seal 30 and an exterior seal 32. The interior seal 30 prevents contamination from migrating from one connector half to another connector half 14 and 16. The exterior seal 32, which is mounted between the respective housings 18 and 20 at the periphery thereof, prevents contamination from entering the connector assembly 10 at the outer juncture of the connector halves 14 and 16.

The two connector halves 14 and 16 are joined together to form the connector assembly 10 of the present invention by means of a bolt 34 which has a shank 36 that is received through aligned openings 38 in housings 18 and 20 and an opening in the interior seal 30. The bolt 34 secures the connector halves 14 and 16 when a nut 42 is screwed on to the free end of the shank 36 at the opposite end of the connector assembly 10. It is important to note that the length of shank 36 is such that the free end thereof will extend beyond housing 20 only when the connector halves 14 and 16 are fully mated to one another.

Figure 4:
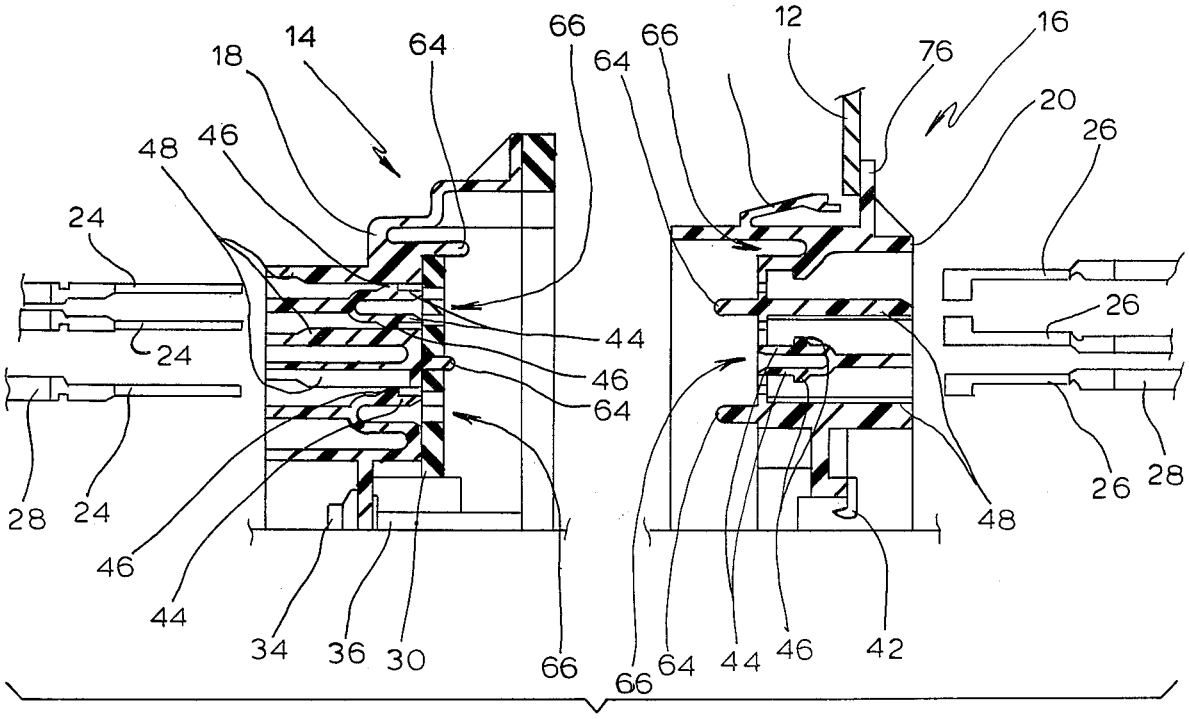
FIG. 4 is a partial side sectional view of the connector assembly of the present invention prior to inserting terminals within their respective housing.
Figure 5:
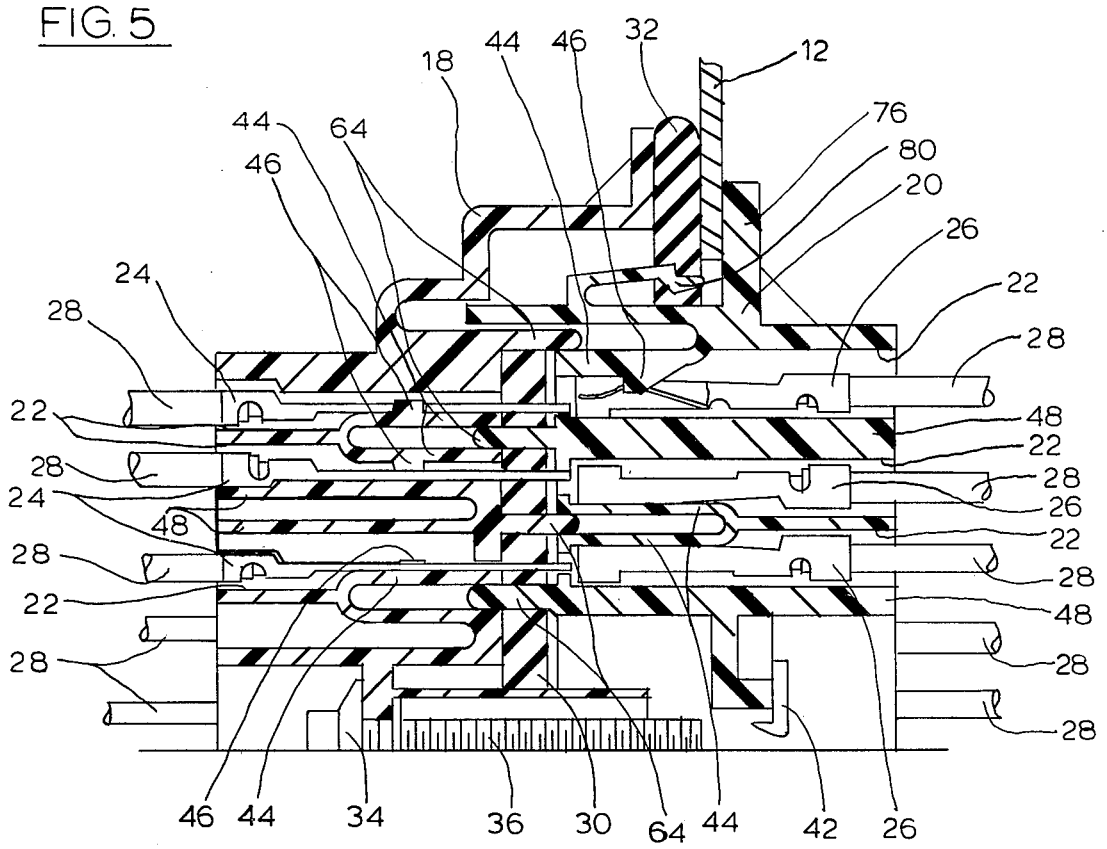
FIG. 5 is a partial side sectional view of the connector halves comprising the collector assembly of the present invention in a partially mated configuration.

Turning now to FIG. 4, each terminal receiving cavity 22 is seen to generally include a relatively flexible wall 44 having a protrusion 46 formed thereon and a relatively rigid wall 48 spaced from and opposing the flexible wall 44. Each cavity 22 is adapted to receive a terminal 24 or 26 therein between walls 44 and 48 in a manner to be discussed in greater detail hereinafter.

Turning now to FIG. 3, each female terminal 26 has a female contact portion 50 with an aperture 52 formed therein and a crimp section 54 which is crimped around the wire 28. Each male terminal 24 has a male or blade contact portion 56 with an aperture 58 formed therein and a crimp section which is crimped around the wire 28.

Each terminal 24 and 26 is adapted to be received within its respective terminal receiving cavity 22 in a sliding fashion. When each terminal 24 and 26 is fully inserted, it is locked within the cavity by the interengagement of the protrusion 46 and the aperture 52 or 58. In order to provide the above described interengagement, the flexible wall 44 is moved away from the terminal 24 and 26 as it is slid into its cavity 22 until its protrusion 46 is received within the aperture 52 or 58.

In order to prevent the mating of the connector halves 14 and 16 if any one terminal 24 and 26 is not fully inserted into its corresponding cavity 22, there is provided a plurality of polarizing projections 64 formed between every other cavity 22 as is best shown in FIG. 4. The projections 64 are adapted to be received within corresponding recesses, generally designated 66, formed adjacent each terminal receiving cavity 22 in the opposite housing 18 or 20 when the connector halves 14 and 16 are fully mated. Each of the recesses 66 is defined between the two opposing flexible walls 44 which are common to the adjacent cavities 22.

Figure 8:
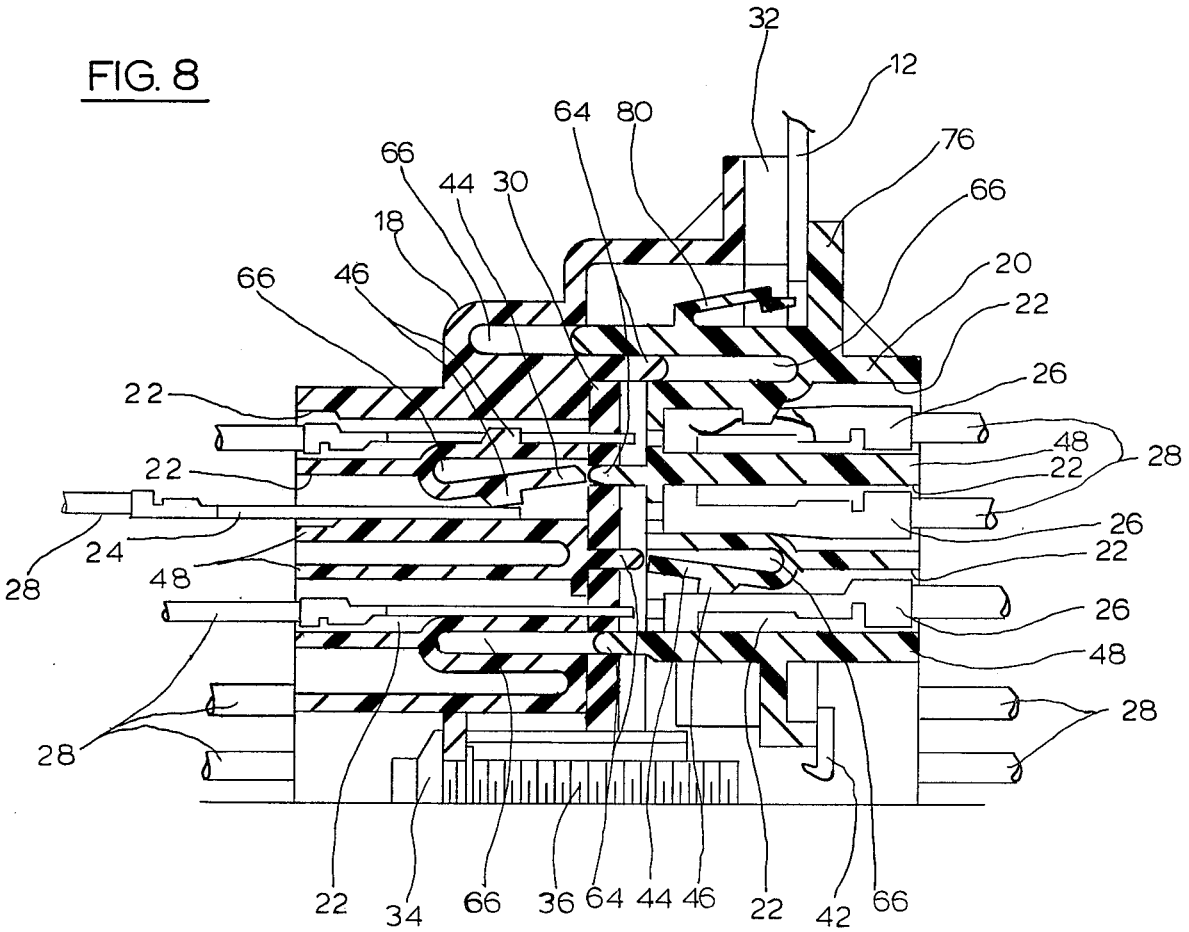
FIG. 8 is a partial side sectional view of the connector halves comprising the connector assembly of the present invention wherein some of the terminals are not fully inserted within the their corresponding cavities.

The flexible wall 44 is movable towards the interior of the recess 66 when a terminal 24 or 26 in the adjacent cavity 22 is not fully inserted therein. As is best shown in FIG. 8, if a terminal 24 or 26 is not fully inserted, the protrusion 46 abuts against the contact portion 50 or 56 of terminal 24 or 26 which biases the flexible wall 44 towards the opposing flexible wall of the recess 66. In this configuration, it is impossible for the polarizing projection 64 to be received within its respective recess 66. The connector halves 14 and 16 are spaced apart. Because of the length of the shank 36 of the bolt 34, the free end thereof will not received through the opposite connector half. Therefore, it is impossible for the nut 46 to be screwed on to the end of the shank 36 when the connector halves are in the configuration as shown in FIG. 8.

Figure 6:
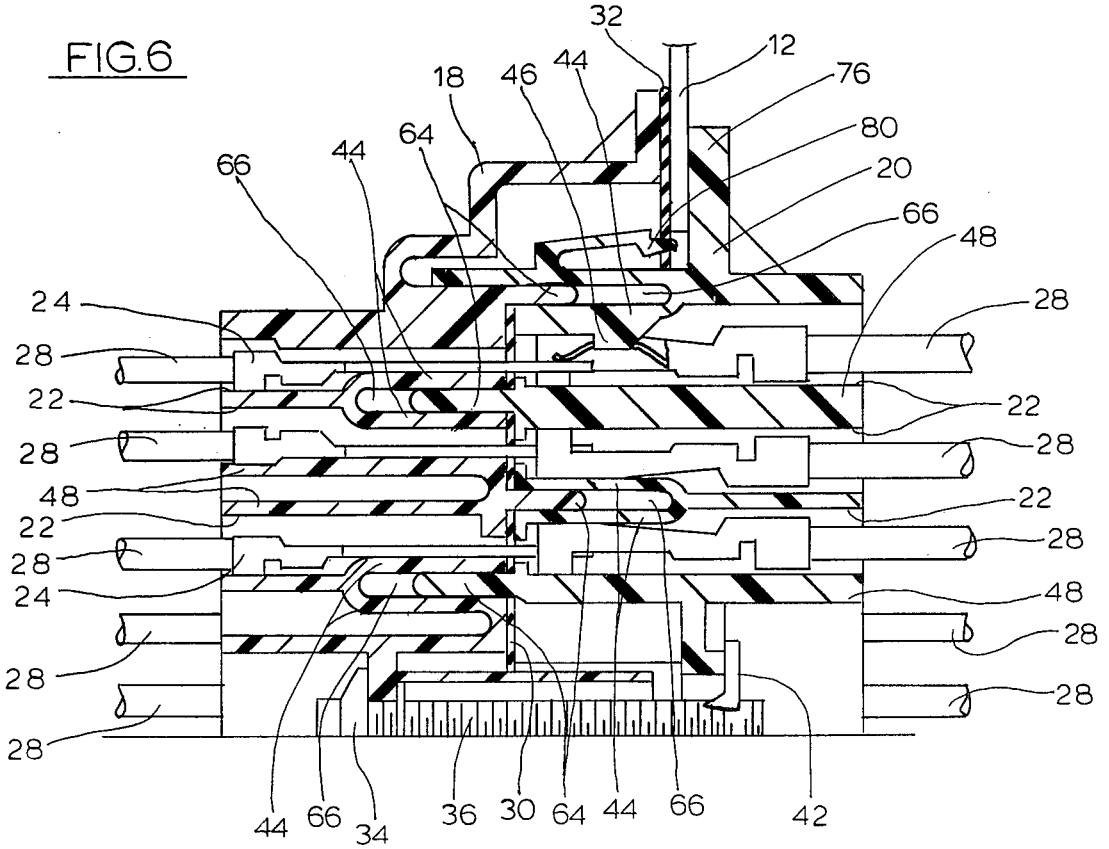
FIG. 6 is a partial side sectional view of the connector halves comprising the connector assembly of the present invention when in a fully mated configuration.
Figure 7:
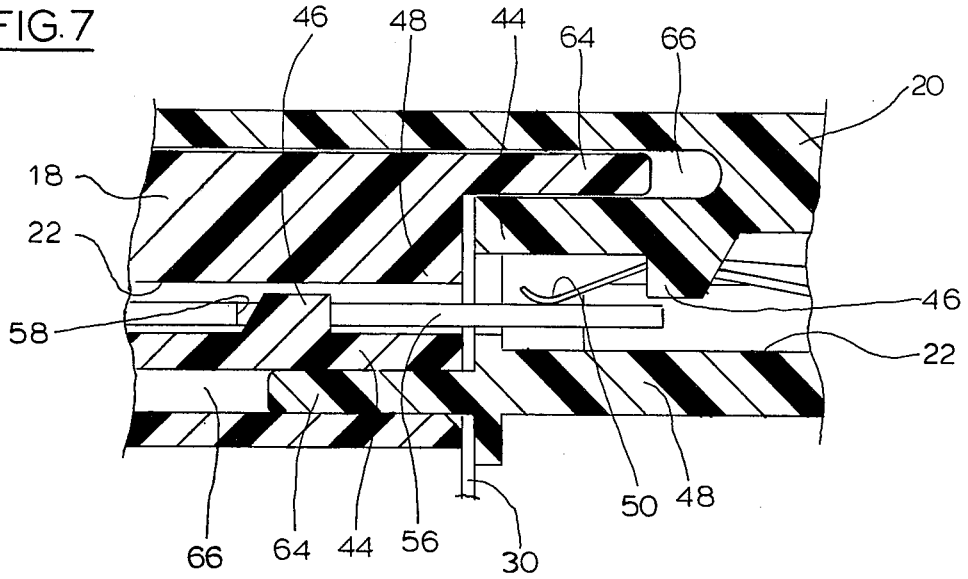
FIG. 7 is an enlarged side sectional view of a portion of FIG. 6.

When the connector halves 14 and 16 are fully mated as is shown if FIG. 6, the male or blade contact portions 56 are received through slits 70 formed in the interior seal 30 so that they may contact its mating female contact portion 50 in the opposite connector half. Also provided is a lock washer 72 (FIG. 2) which serves to position and secure the connector halves 14 and 16 together.

The connector assembly 10 is mounted on the panel 12 by a pair fasteners (not shown) which are received through holes 74 formed on flanges 76 of housing 18. The flanges 76 are disposed on one side of panel 12, while flexible mounting ears 80 formed on housing 18 are disposed on the opposite side of the panel 12 as is best shown in FIGS. 2 and 6.

We claim:

1. A connector assembly including a pair of mateable connector halves, each connector half having a housing with a plurality of terminal receiving cavities formed therein facing opposing cavities formed in the housing of the other connector half, each cavity having a wall, a group of terminals mounted in said cavities along side of the wall, the terminals mounted in said opposing cavities being in alignment with one another to define mateable terminal pairs, and terminal locking means cooperating between each terminal and the wall of its respective cavity to lock said terminal therein, said locking means having means interengaging between said cavity wall and the terminal only when said terminal is fully inserted within its cavity, whereby the terminal pairs are mated when the connector halves are moved together, the improvement in said connector assembly including means for preventing the mating of the connector halves if any one terminal is not fully inserted into its corresponding cavity, said mating prevention means comprising:

a plurality of relatively rigid polarizing projections integrally formed with and extending from at least one housing between at least some of said cavities, said projections are adapted to be received within corresponding recesses formed adjacent each terminal receiving cavity in the opposite housing when said connector halves are fully mated, each recess having a flexible wall that is common with the adjacent cavity, said flexible wall being movable towards the interior of the recess when the terminal in the adjacent cavity is not fully inserted therein preventing the receipt of the corresponding projection in said recess, whereby the connector halves cannot be mated if any one projection cannot be received in its corresponding recess.

2. The connector assembly of claim 1 wherein said locking means includes a protrusion on the flexible wall near the forward end thereof generally protruding towards the interior of the terminal receiving cavity and is adapted to be received within an aperture formed in the terminal in an interengaging fashion, the relative location of said protrusion and aperture being such that interengagement cannot occur unless the terminal is fully inserted into its cavity, said flexible wall being resiliently moveable between a first position before the terminal is inserted which is generally parallel to the axis of the terminal, a second position during insertion of the terminal so that the protrusion is biased against the terminal forcing the forward end of the flexible wall towards the interior of the adjacent recess, and a third position when the terminal is fully inserted so that the locking means is interengaged allowing the flexible wall to return to its initial position.

3. The connector assembly of claim 2 including means to mechanically lock one connector half to the other only when all of the terminals are fully inserted, said locking means including bolt means having a shank portion receivable through both connector halves with a free end extending out of said assembly, a nut adapted to be screwed onto the free end of the shank portion after the connector halves are fully mounted to one another and the terminals mated, the shank being of such a length so that the free end thereof will not extend through the connector assembly a sufficient distance to allow the nut to be mounted thereon if any one terminal is not fully inserted.

4. The connector assembly of claim 1 wherein each recess is formed between two flexible walls of two adjacent terminal receiving cavities on either side of said recess and wherein said corresponding projection cannot be received in the recess when one of said flexible walls is slanted toward the other of said flexible walls.

5. The connector assembly of claim 4 wherein the projections extend between adjacent terminal receiving cavities from the housing opposite the corresponding recess.

6. The connector assembly of claim 1 including an environmental seal interfacing between said connector halves, said seal comprising a thin resilient gasket having an area generally congruent with the connector halves and a plurality of slits formed therein through which the projections and terminals are received for mating with the other connector half.

7. The connector assembly of claim 1 including means on one housing for mounting said assembly on a panel.

* * * * *